US006464576B1

(12) United States Patent
Freeman et al.

(10) Patent No.: US 6,464,576 B1
(45) Date of Patent: Oct. 15, 2002

(54) STACKED POLISHING PAD HAVING SEALED EDGE

(75) Inventors: Peter W. Freeman, Bear, DE (US); Marco A. Acevedo, Mesa, AZ (US); Jon D. Jacobs, Jr., Newark, DE (US)

(73) Assignee: Rodel Holdings Inc., Wilmington, DE (US)

( * ) Notice: Subject to any disclaimer, the term of this patent is extended or adjusted under 35 U.S.C. 154(b) by 89 days.

(21) Appl. No.: 09/635,877

(22) Filed: Aug. 10, 2000

Related U.S. Application Data

(60) Provisional application No. 60/151,553, filed on Aug. 31, 1999, and provisional application No. 60/156,613, filed on Sep. 29, 1999.

(51) Int. Cl.[7] ..... B24D 11/00

(52) U.S. Cl. ..... 451/533; 451/534; 451/538; 451/539

(58) Field of Search ..... 451/533, 534, 451/538, 539, 59, 530, 537, 550; 51/297, 295

(56) References Cited

U.S. PATENT DOCUMENTS 5,403,228 A * 4/1995 Pasch ..... 451/259

* cited by examiner

*Primary Examiner*—Timothy V. Eley
*Assistant Examiner*—Colin J. Grant
(74) *Attorney, Agent, or Firm*—Gerald K. Kita; Konrad Kaeding; Kenneth A. Benson

(57) ABSTRACT

A stacked polishing pad includes an upper polishing layer and a lower sub-layer having major faces which are in contact with each other. The polishing layer is substantially impermeable to liquid while the sub-layer is liquid absorbent. The sub-layer has an outer peripheral edge which is sealed to prevent absorption of liquid into the sub-layer through the outer peripheral edge. When the stacked polishing pad is mounted on a platen of a polishing machine, the sub-layer has no exposed surface which can absorb liquid.

14 Claims, 2 Drawing Sheets

STACKED POLISHING PAD HAVING SEALED EDGE

CROSS-REFERENCE TO RELATED APPLICATIONS

This application claims the benefit of U.S. Provisional Application No. 60/151,553 filed Aug. 31, 1999 and U.S. Provisional Application No. 60/156,613 filed Sep. 29, 1999.

BACKGROUND OF THE INVENTION

1. Field of the Invention

The invention relates to a polishing pad which is useful for planarizing a semiconductor wafer or other substrate, and in particular, to a polishing pad of the type having multiple stacked layers.

2. Background of the Invention

"Microelectronic substrate" is intended to mean semiconductor devices or precursors thereto, including semiconductor wafers, semiconductor device layers comprising an insulator, semiconductor, barrier layer, conductor or any combination thereof.

A microelectronic substrate must be polished to provide a very smooth and planar surface that in some cases may vary from a given plane by as little as a fraction of a micron. Such polishing is usually accomplished in a chemical-mechanical polishing (CMP) operation which utilizes a chemically active slurry that is buffed against the wafer surface by a polishing pad.

A polishing pad is often a relatively thin, disk-shaped article that is mounted on a platen of a polishing machine. Some polishing pads comprise two or more layers of different materials, which are coextensively stacked and secured together by adhesive.

In the case of a stacked two layer pad, an upper layer is a polishing layer that is relatively hard and stiff to attain a high rate of material removal while maintaining a substantially planar polishing surface while removing the material during a polishing operation. The upper layer is substantially impermeable to liquid constituents borne by the slurry and to de-ionized water, which accompany a polishing pad during polishing and washing operations.

A lower layer is a sub-layer that is softer than the upper layer to cushion the upper layer. The sub-layer tends to be permeable to slurry borne liquid and de-ionized water. The sub-layer is shielded from these liquids by being coextensive with the impermeable upper layer and adhesive. However, a peripheral edge of the sub-layer is unshielded and is exposed to permeation by the liquid. By allowing liquid to penetrate the sub-layer, physical properties of the sub-layer may change, thereby changing the cushioning effect of the sub-layer to the detriment of polishing performance by the stacked polishing pad.

Further, a stacked polishing pad may be of a type that has a transparent window through which is trained an optical path for optical detection equipment to detect when a polishing endpoint is attained by a polishing operation. Allowing liquid to penetrate the sub-layer, may disturb the optical path.

SUMMARY OF THE INVENTION

The present invention is directed to a stacked polishing pad comprising a polishing layer and a sub-layer. The polishing layer is substantially liquid impermeable (or is substantially less liquid permeable than the sub-layer), while the sub-layer is liquid permeable (or at least significantly more liquid permeable relative to the polishing layer). The polishing layer that is stacked on the sub-layer provides a liquid impermeable shield for an upper surface of the sub-layer. The sub-layer is mounted against a platen of a known polishing machine, which would further shield the sub-layer. According to an embodiment of the invention, the sub-layer has an outer peripheral edge which is sealed to prevent liquid permeation into the sub-layer.

According to another embodiment of the invention, the stacked polishing pad has an opening that is delineated by an inner peripheral edge extending through the multiple layers of the polishing pad. The inner peripheral edge of the sub-layer is sealed to prevent permeation of liquid into the sub-layer.

The peripheral edge of the sub-layer may be sealed by any suitable means including a heat seal, a pressure embossed seal, and a waterproof coating.

According to another embodiment of the invention, the polishing pad is provided with one, or more than one, opening extending through the multiple layers of the polishing pad. Any of the respective inner peripheral edges of the openings may be unsealed, by having the material of the sub-layer exposed, which provides liquid absorption regions in the sub-layer adjacent to unsealed, open vias through the pad.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
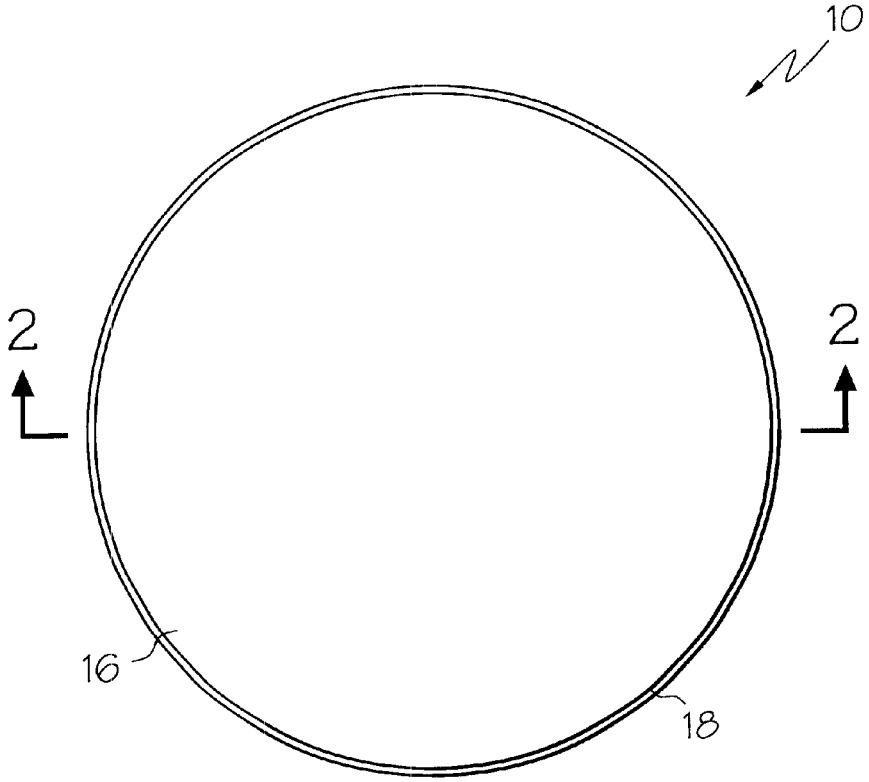
FIG. 1 is a top plan view of a stacked polishing pad according to the invention.
Figure 2:
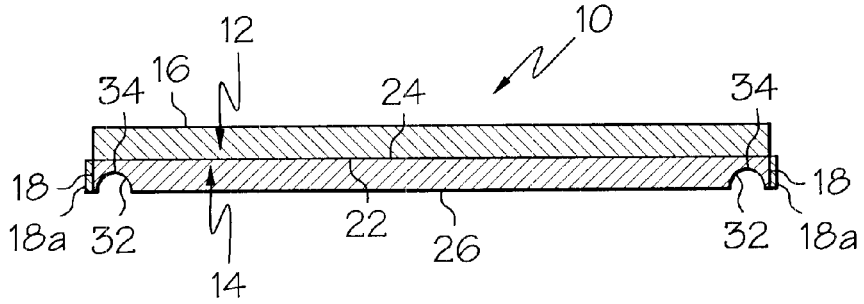
FIG. 2 is a cross-sectional view of the polishing pad taken along line 2—2 of FIG. 1.

As shown in FIGS. 1 and 2, a stacked polishing pad 10 according to an embodiment the invention comprises an upper layer 12 and a lower layer 14. The upper layer 12 is a polishing layer having a polishing surface 16. The polishing layer comprises a material having constituents to provide an effective combination of polishing characteristics. The material of the polishing layer should be relatively hard and stiff to attain a high material removal rate and good surface planarity and uniformity of a polished, planarized microelectronic substrate. An example of an effective polishing layer material is sold under the name IC 1000 by Rodel, Inc., of Newark, Del., USA. The polishing layer material is substantially impermeable to de-ionized water and slurry borne liquid used in the polishing and washing processes of a CMP operation.

The lower layer or sub-layer 14 is softer than the polishing layer 12. The softer sub-layer 14 provides a cushion that permits the polishing layer 12 to conform to macro-scale surface irregularities on a microelectronic substrate that is being polished. An example of an effective sub-layer material is that which is sold under the name Suba IV by Rodel, Inc., of Newark, Del. USA. This material is somewhat permeable to de-ionized water and slurry based liquid.

The polishing layer 12 and the sub-layer 14 have respective major surfaces 22, 24 which are in contact at an interface and are secured together by an adhesive. The polishing layer 12 and the adhesive shield the top major surface 24 of the sub-layer 14 from contact with polishing liquids. Prior to polishing, bottom major surface 26 of the sub-layer is secured to a platen of a polishing machine (not shown) by an adhesive, thereby preventing liquid contact with the bottom major surface 26.

According to an embodiment of the invention, a sealed outer peripheral edge 18 of the sub-layer 14 prevents liquid permeation into the sub-layer 14 through the outer peripheral edge 18. A sealed peripheral edge 18 may be provided by any suitable technique which is effective to create a barrier to liquid permeation. A seal forms at or near the peripheral edge 18, and extends to where the surface of the sub-layer 14 meets the polishing layer 12, and to where such surface of the sub-layer 14 adhesively secures to the platen on which the polishing pad 10 is mounted during the CMP operation.

As shown in FIG. 2, the edge 18 may be sealed against liquid permeation, for example, by pressure-embossing the sub-layer 14 to form a continuous indentation 32 that circumscribes the edge margin of the sub-layer 14 at or near the outer peripheral edge 18. Material of the sub-layer 14 is displaced by the indentation 32, and forms, or otherwise provides, compacted material 34 extending in a continuous zone that circumscribes the edge margin of the sub-layer 14 at or near the outer peripheral edge 18. The compacted material 34 is of substantially increased density, and closes any pores in the material of the sub-layer 14, to become substantially impermeable to liquid, which, in turn, becomes the mechanism by which the outer peripheral edge 18 is sealed against liquid permeation.

In a preferred embodiment, the indentation 32 has a U-shaped cross-section which is 0.035 inch deep and 0.063 inch wide in a sub-layer 14 that is 0.050 inch thick, and the indentation 32 is offset 0.250 inch radially inward from the outer peripheral edge 18. Alternatively, the indentation 32 may have a V-shape or any other suitable cross-sectional shape.

Heating the peripheral edge 18 causes the material of the sub-layer 14 to fuse, or glaze, particularly to encircle the pores with heat induced sealed material, forming a heat induced seal against liquid permeation, extending in a continuous zone that circumscribes the edge margin of the sub-layer 14 at or near the outer peripheral edge 18.

A sealed edge 18 may be provided by a thin waterproof coating 18*a* of a material such as a silicone rubber that is applied over, and that adheres to, the surface of the peripheral edge 18. The waterproof coating 18*a* forms a seal against liquid permeation, extending in a continuous zone that circumscribes the edge margin of the sub-layer 14 at or near the outer peripheral edge 18. For the purpose of illustration, the waterproof coating 18*a* is shown in FIG. 2, together with the indentation 32. However, either the waterproof coating 18*a* or the indentation 32 may be provided without the other.

Figure 3:
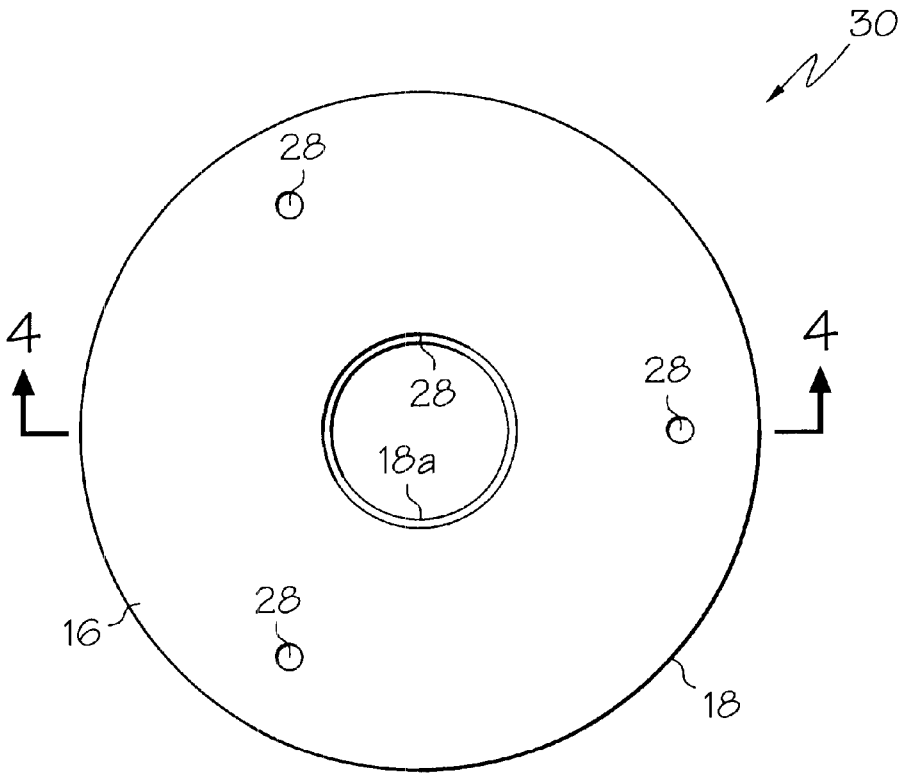
FIG. 3 is a top plan view of a stacked polishing pad in an alternate embodiment according to the invention.
Figure 4:
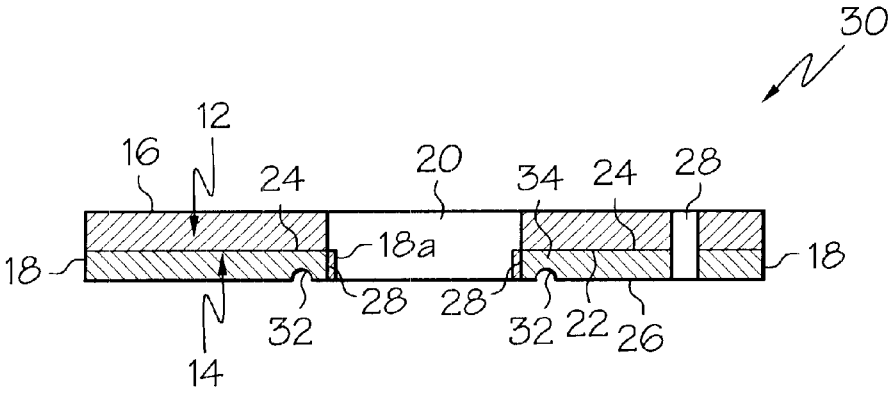
FIG. 4 is a cross-sectional view of the polishing pad taken along lines 4—4 of FIG. 3.

Another embodiment of the invention is shown in FIGS. 3 and 4 wherein elements which are the same as in FIGS. 1 and 2 are denoted by the same reference numerals. In this embodiment, a stacked polishing pad 30 has an annular outer peripheral shape, and includes an opening 20 that is delineated by an inner peripheral edge 28. The opening 20 provides an open via, or passage, through the pad 10, for example, for transport of slurry or washing liquid. Alternatively, for example, the opening 20 removes a selected area of the polishing pad 10 to purposely avoid polishing within the selected area. The inner peripheral edge 28 extends through both the polishing layer 12 and the sub-layer 14. Any peripheral edge 28 of the sub-layer 14 is sealed by a seal that is provided according to any of the suitable techniques as discussed above with regard to the outer peripheral edge 18. The embodiment, as shown in FIG. 3, has a single opening 20 that is centrally located, and is of generous cross sectional area. The stacked polishing pad 10 may have one, or more than one, opening 20, for example, serving as properly positioned, open vias through the pad 10, such openings 20 having desired cross sectional areas and shapes, which are delineated by respective inner peripheral edges 28. A selected one, or more than one, of the respective inner peripheral edges 28 of respective openings 20 may be sealed to prevent liquid permeation into the sub-layer 14.

Further, a selected one, or more than one, of the respective inner peripheral edges 28 may be unsealed, by having the material of the sub-layer 14 exposed, which provides liquid absorption regions in the sub-layer 14 adjacent to open vias through the pad 10. For example, the liquid absorption regions may be useful in providing gradations of localized cushioning softness in the sub-layer 14.

Although embodiments of the invention are disclosed, other embodiments and modifications are intended to be covered by the spirit and scope of the appended claims.

We claim:

1. A polishing pad for use in polishing a microelectronic substrate comprising:

a polishing layer adapted to polish said substrate, the polishing layer being substantially impermeable to liquid, a sub-layer of liquid permeable material on which the polishing layer is stacked, and an outer peripheral edge of the sub-layer extending out from under the polishing layer, the outer peripheral edge having a seal that is uncovered by the polishing layer, the seal being impermeable to prevent liquid permeation into the sub-layer.

2. The polishing pad of claim 1 wherein the seal is a continuous zone of heat sealed material of the sub-layer.

3. The polishing pad of claim 1 wherein the seal is a continuous zone of compacted material of the sub-layer.

4. The polishing pad of claim 1 wherein the seal is a waterproof coating.

5. The polishing pad of claim 4 wherein the waterproof coating comprises a silicone rubber.

6. The polishing pad of claim 1 wherein the sub-layer has an inner peripheral edge, the inner peripheral edge having a respective seal that prevents liquid permeation into the sub-layer.

7. The polishing pad of claim 6 wherein the inner peripheral edge has a circular shape.

8. The polishing pad of claim 6 wherein the respective seal is a heat seal.

9. The polishing pad of claim 6 wherein the respective seal is an embossed seal.

10. The polishing pad of claim 6 wherein the respective seal is a waterproof coating.

11. The polishing pad of claim 10 wherein the waterproof coating comprises a silicone rubber.

12. The polishing pad recited in claim 1, and further comprising:

of one or more openings through the sub-layer having an inner peripheral edge, each inner peripheral edge being unsealed to provide liquid absorption regions in the sub-layer.

13. The polishing pad recited in claim 1, and further comprising:

each of one or more openings through the sub-layer having an inner peripheral edge, each inner peripheral edge being sealed by a seal that is uncovered by the polishing layer to prevent permeation of liquid through the seal.

14. The polishing pad recited in claim 1, and further comprising:

each of one or more openings through the sub-layer having an inner peripheral edge, each inner peripheral edge being, either unsealed to provide liquid absorption regions in the sub-layer, or sealed by a seal that is uncovered by the polishing layer to prevent permeation of liquid through the seal.

* * * * *